US006309171B1

(12) United States Patent
Arck et al.

(10) Patent No.: US 6,309,171 B1
(45) Date of Patent: Oct. 30, 2001

(54) MOBILE LOADING MACHINE WITH FRONT-END LOADING EQUIPMENT

(75) Inventors: Heinrich Arck, Augaburg; Robert Höllwart, Oberottmarshausen; Gustav Leidinger, Friedberg, all of (DE)

(73) Assignee: O&K Orenstein & Koppel Aktiengesellschaft, Dortmund (DE)

( * ) Notice: Subject to any disclaimer, the term of this patent is extended or adjusted under 35 U.S.C. 154(b) by 0 days.

(21) Appl. No.: 09/610,776

(22) Filed: Jul. 6, 2000

Related U.S. Application Data

(63) Continuation of application No. PCT/EP98/05602, filed on Sep. 4, 1998.

(51) Int. Cl.[7] ..... E02F 3/43
(52) U.S. Cl. ..... 414/706; 414/697
(58) Field of Search ..... 414/685, 700, 414/701, 697, 715, 706, 707, 708, 712

(56) References Cited

U.S. PATENT DOCUMENTS 3,634,900 * 1/1972 Prescott et al. ..... 414/715 X
4,798,512 * 1/1989 Intveld ..... 414/697 X

FOREIGN PATENT DOCUMENTS

2827283 * 1/1979 (DE) ..... 414/697

* cited by examiner

*Primary Examiner*—Donald W. Underwood
(74) *Attorney, Agent, or Firm*—Rosenman & Colin LLP

(57) ABSTRACT

In the case of a mobile loading machine with front-end loading equipment, in particular a construction machine, having a lifting frame (1) which is rotatably mounted by the rear end on a front frame part (13) of the loading machine (L) in a lifting-frame pivot point (14) and which can be raised and lowered by means of at least one lifting cylinder (2), a working shovel (5), fork (5') or the like being coupled to the front end of the lifting frame (1) in a shovel pivot point (6), and a tipping lever (3) being coupled in a central region of the lifting frame (1) in a tipping-lever pivot point (15), the lower end of which lever is connected in a tipping-cylinder coupling point (8) in an articulated manner to a tipping cylinder (7) which is coupled at the other end in a tipping-cylinder pivot point (18) to the frame part (13) and whose upper end is coupled in a tipping-rod pivot point (17) to a tipping rod (4) which is coupled by its other end to the working shovel (5) in a tipping-rod coupling point (21) above the shovel pivot point (6), the intention is to further improve the kinematic system, which is achieved by special geometrical ratios.

8 Claims, 5 Drawing Sheets

MOBILE LOADING MACHINE WITH FRONT-END LOADING EQUIPMENT

Figure 1:
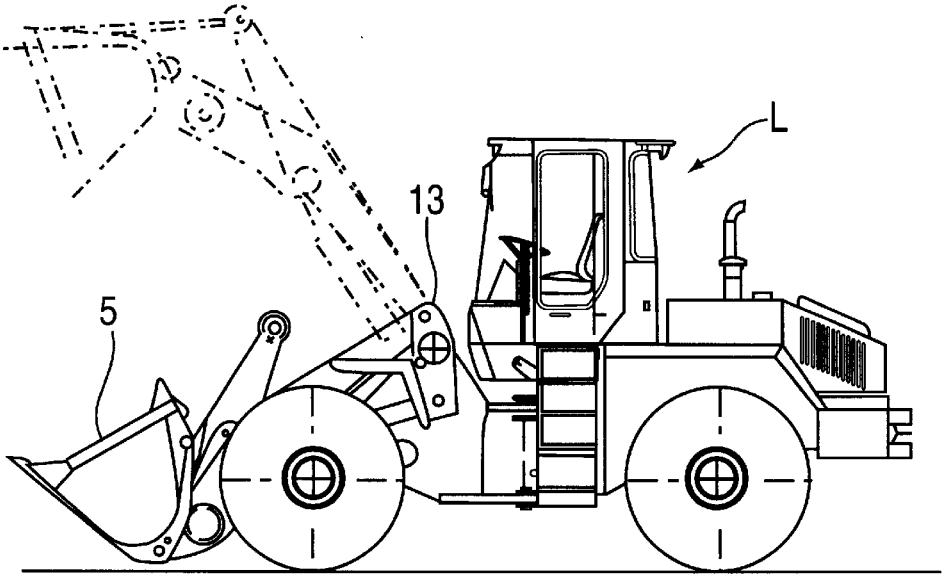

This application is a continuation of international application number PCT(EP) 98/05602, filed Sep. 4, 1998.

The invention relates to a mobile loading machine with front-end loading equipment, in particular a construction machine, having a lifting frame which is rotatably mounted by the rear end on a front frame part of the loading machine in a lifting-frame pivot point and which can be raised and lowered by means of at least one lifting cylinder, a working shovel, fork or the like being coupled to the front end of the lifting frame in a shovel pivot point, and a tipping lever being coupled in a central region of the lifting frame in a tipping-lever pivot point, the lower end of which lever is connected in a tipping-cylinder coupling point in an articulated manner to a tipping cylinder, which is coupled at the other end in a tipping-cylinder pivot point to the frame part, and whose upper end is coupled in a tipping-rod pivot point to a tipping rod which is coupled by its other end to the working shovel in a tipping-rod coupling point above the shovel pivot point.

In the case of wheel loaders essentially two areas of use are distinguished, namely earth moving and industrial use. The so-called Z-kinematics is widespread for the first-mentioned application. The Z-kinematics carries out the requirements of earth moving in an advantageous manner, since it has large tear-out forces within the range of the lower lifting-frame position, and the shovel tips back while being raised in order to avoid losses of material during transportation, and it has sufficient holding forces within the upper lifting range while the shovel is being tipped out. However, the profile of the holding force above the shovel angle in the upper position of the lifting frame is such that it reaches the minimum value of the holding force in the furthest forward position of the center of gravity of the shovel. That this holding force is nevertheless sufficient in this position is based on the fact that in this position a large part of the material has already fallen out of the shovel, so that the load has been greatly reduced as a result. This fact makes this system unsuitable for industrial use, since in this case the goods being transferred, such as pipes, tree trunks etc., have to be secured until the largest tipping-out angle is reached or, when picking them up from a stack, have to be tipped back for transfer into the transportation position. A further disadvantage of the Z-kinematics is the profile of the angular speed of the working implement in the upper positional range of the lifting frame. The speed sharply decreases in the region of large tipping-out angles and, as a result, knocking out of material residues adhering in the shovel is possible only to a limited extent.

A further feature of the Z-kinematics is that the tear-out force, which is configured to meet the requirements of removing material, has its highest value within the range of a horizontal shovel (ground) position, but sharply decreases with an increasing tipping angle. The tear-out force in the maximum tipping angle has fallen so far, in the shovel lifting height which is customary for transportation, that in the event of sharp braking deceleration actions and/or in the event of very uneven terrain, the shovel can no longer be pressed on with the necessary force, which causes sharp impacts associated with a corresponding production of noise.

For industrial purposes a parallel kinematics is generally used. A parallel kinematics of this type enables the shovel to be guided parallel via the lifting movement of the lifting frame, and also there is a more favorable profile of the holding forces within the upper lifting-frame region during the tipping-out process. There is also a continuous increase in the angular speed even within the last angular range during the tipping-out process, which makes it possible to beat out material adhering in the shovel. A disadvantage of this system is that for removing the material the tipping cylinder or tipping cylinders is/are only subjected to hydraulic pressure over their annular surface, and so these surfaces have to have appropriately large dimensions.

A further disadvantage of the parallel kinematics is that the tipping cylinders have to be arranged on the front frame of the loader at a considerable distance above the coupling point of the lifting frame, which produces a pillar-like construction of the front frame which impairs the view of the working implement.

These reasons have led, among other things, to the development of dedicated kinematic systems for industrial use, the said systems being based on the Z-kinematics, because of the prevailing advantages with it, but eliminating, by means of further elements, the shortcomings in the upper lifting-frame position in the case of the tipping-out process described. This is predominantly done by attaching an additional four-bar linkage between the links forming the characteristic Z and the working implement. The required holding force can therefore be achieved over the entire angular range of the working implement. When the lift-truck fork is used, industrial use requires it to be largely raised parallel, while in the case of use with a shovel or clamp, tipping back is advantageous in order to bring the center of gravity of the load closer to the vehicle. Since these contradictory requirements cannot be implemented without further precautions, a compromise has to be made when designing a system of this type. Skillful configuring of the kinematic system makes it possible, with the initially horizontal lift-truck fork pulled back only moderately, for the shovel or clamp which is entirely tipped back to be pulled back more strongly in the manner sought during the lifting process. The possibilities produced by the additional number of links in the kinematic linkage permit a far-reaching solution which meets the requirements of the particular use, if with certain trade-offs. Systems having two tipping mechanisms are also opposed here to those having just one tipping mechanism. The first-mentioned systems have the disadvantage that their elements are situated above the lifting-frame front faces and largely conceal the driver's view of the lateral ends of the goods being transported in industrial use. Therefore, solutions are move favorable which have only a centrally arranged tipping mechanism which leaves open the view of the ends of the loaded goods. However, because of their additional elements, these kinematic systems are more complicated and, since they are arranged in the front lifting-frame region, reduce the tipping load and therefore also the permissible loading capacity.

GB 2,266,291 A discloses a loading machine of the generic type with front-end loading equipment, which in principle consists only of a three-part kinematic linkage, namely a tipping cylinder, a tipping lever and a tipping rod, it being possible for the tipping cylinder to be fastened to the tipping lever in different positions, so that different kinematic geometries can be realized in order to be able to satisfy different requirements. However, it has turned out in practice that this known kinematics is still in need of substantial improvement.

The object of the invention is to further improve the kinematic system of a loading machine according to the generic type in order to combine all of the advantageous characteristics of the Z-kinematics, the parallel kinematics and the industrial kinematics in one system and to avoid the disadvantages thereof, the intention being that the complexity and therefore the costs do not exceed those of a conventional Z-kinematics.

According to the invention, this object is achieved with a mobile loading machine of the type described at the beginning by the following geometrical ratios being provided, in each case based on the length l of the lifting frame:

- lifting-frame length $l_1$ between the tipping-lever pivot point and shovel pivot point: $l_1/l=0.25$ to 0.4,
- distance a from the tipping-lever pivot point to the tipping-rod pivot point: a/l=0.3 to 0.35,
- distance b from the tipping-lever coupling point to the tipping-lever pivot point: b/l=0.14 to 0.17,
- distance c from the tipping-rod coupling point to the shovel pivot point: c/l=0.2 to 0.3,
- height h of the tipping-lever pivot point above the lifting-frame axis: h/l=0.08 to 0.12,
- length s of the tipping rod: s/l=0.4 to 0.5,
- vertical distance g of the tipping-cylinder pivot point to the lifting-frame pivot point: g/l=0.07 to 0.08,
- horizontal distance f of the tipping-cylinder pivot point to the lifting-frame pivot point: f/l=0.06 to 0.07.

In practice, it has turned out after lengthy research work, that by means of this special design according to the invention, i.e. by means of the precise position of the pivot points with respect to one another, the lever ratios and the precise lengths of the individual components in their special arrangement, the known kinematics can be substantially improved, there furthermore only being required a simple, three-part kinematic linkage consisting of a tipping cylinder, a tipping lever and a tipping rod.

In this arrangement, provision is preferably also made for a second tipping-cylinder coupling point for the tipping cylinder to be provided on the tipping lever, the distance of the second, upper tipping-cylinder coupling point from the first, lower tipping-cylinder coupling point, based on the lifting-frame length, being between 0.01 and 0.12. By means of a simple change in position of the tipping cylinder, the kinematics can therefore be converted from the sequence of movement as in the case of a Z-kinematics for earth moving, to an industrial kinematics with the working implement being guided parallel. In this case, the lower tipping-cylinder coupling point is preferably provided for earth moving. In the upper position of the lifting frame, the holding force is then sufficient, even in the region of greatest need and is, approximately as far as the maximum tipping-out angle, in line with the need as it is reduced in accordance with the reducing load moment. This also has the result that in the upper lifting-frame position, even in the horizontal position of the working implement, the tear-out forces are large and are comparable to those in the lower lifting-frame position.

In contrast to the Z-kinematics, the tear-out forces here therefore remain approximately constant over the lifting height of the lifting frame. Therefore, when removing the material from a solid wall with the system according to the invention, said material can still be broken with a high tear-out force, even in the upper lifting range. The tipping-out takes place by introducing hydraulic oil into the annular space in the tipping cylinder.

The tipping-out speed of the working implement increases super proportionally in the last angular range of pivoting, as a result of which the shovel moves, up to the tipping-out angle of 30 to 35° in which the material is largely emptied, at a speed which is easy to control by the driver, but at the maximum tipping-out angle the stops are reached at a high speed which makes it possible for material residues which have adhered firmly to be knocked out. This speed profile also enables the emptied shovel to be tipped back rapidly until approximately in its horizontal position, although the entire cylinder/piston surface is acted upon here.

The lifting frame advantageously has a crossbeam which is arranged between the tipping-lever pivot point and the shovel pivot point and supports the tipping lever by means of the tipping-lever support. In this arrangement, this crossbeam is preferably arranged away from the tipping-lever pivot point at a distance which is larger than the distance of the tipping-cylinder coupling point to the tipping-lever pivot point.

In order to improve the driver's view of the shovel, the tipping cylinder is advantageously arranged approximately parallel to the lifting-frame longitudinal axis.

When the shovel is being emptied into a transportation vehicle, there is the risk of the sideboard being damaged by the tipping lever. In order to avoid this, the tipping lever is arranged appropriately far from the shovel pivot point and as high as possible above the frame axis, namely in such a manner that the ratio of the distance of the tipping-cylinder coupling point from the tipping-lever pivot point to the lifting-frame length between the tipping lever and shovel pivot point is between 0.4 and 0.5.

Further refinements emerge from subclaims 6 to 8.

In the lower lifting-frame position, when the material is being removed with high tear-out forces being required, said forces are applied by subjecting the entire surface of the tipping cylinder to the hydraulic pressure. With increasing tipping angle, the tear-out forces fall less than in the case of the Z-kinematics. It is a characteristic of the kinematics according to the invention that approximately at a tipping angle of between 35 and 40°, the tear-out forces rise again, whereas in the case of the Z-kinematics they would fall to zero during further tipping. As a result, in the transportation position of the shovel the front end of the piston rod of the tipping cylinder is pressed with high force against the tipping rod in the region of the tipping-rod pivot point on the shovel, so that said shovel does not come free from the stop, even at relatively high deceleration values because of braking or uneven terrain, but rather keeps its position relative to the lifting frame and therefore also to the vehicle. Moreover, the characteristic of the tear-out force rising again from a specified range of the tipping angle allows the implementation of a relatively large maximum tipping angle, as a result of which heaped material can be transported with a reduced risk of some of it being lost, even over uneven terrain. That upper part of the tipping lever which pivots reward during tipping of the working implement releases a relatively large attachment space for said working implement, which space is limited in the case of the Z-kinematics because of the tipping lever moving forward.

The tipping-out angle which is possible on account of the given tipping-cylinder stroke with the shovel cutting edge placed onto the ground is of such a size that the angle is limited not only by the tipping cylinder, but by the stops between the shovel and lifting frame. This signifies a tipping-out angle of noticeably more than 90° in this shovel position, which makes it possible both to cut off foundation ditch walls vertically and also to give support, by means of tipping movements of the shovel, in order to free the loader again after it has become stuck in rough terrain. Since the Z-kinematics only has a tipping-out angle of approximately 70° at the ground level of the shovel, the shovel, which has cut into the ground, is rapidly removed therefrom during the tipping movement. When removing the ground with downwardly protruding teeth or the shovel cutting edge in forward motion, the shovel rests here against the lifting frame, so that the large forces resulting from the advancing force, and also the bumps caused by the uneven yielding of the ground, are conducted directly via the shovel stops into the vehicle. During removal with the shovel in rearward motion, the kinematics according to the invention has a substantially higher holding force than the designs previously known, and so it does not give way because of a reaction of the pressure control valve of the tipping cylinder.

In order to draw back the center of gravity of the load as far as possible during transportation and also during transfer of materials and goods, the working implement is tipped back during the lifting process. In order, when the lift truck is used, to be able to raise the fork prongs in parallel, this parallelism can be achieved by changing the coupling point of the tipping-cylinder lug on the lower part of the tipping lever. This can either take place by changing the position of the tipping cylinder to the second, upper tipping-cylinder coupling point or by displacing the coupling point within the two tabs of the tipping lever using conventional technical means.

Although the holding force is reduced in this case, it still exceeds the requirements arising from the permissible loading capacity for the machine during use as a lift truck.

In the design according to the invention of the kinematics there is the option of arranging the crossbeam in the raised lifting-frame position as close as possible to the shovel pivot point in order to obtain optimum viewing conditions of the working tools. In this case, the arrangement of the tipping cylinder in its position with respect to the lifting frame is selected in such a manner that its longitudinal axis lies approximately parallel to and below the lifting-frame axis in each lifting-frame position and, as a result, in the upper lifting range, in which the shovel is emptied into the transportation vehicles, favorable viewing conditions arise because of the selected position, since only the relatively thin piston rod of the tipping cylinder lies within the field of view of the driver. Even in the lower lifting-frame position, when picking up material, the tipping cylinder is thereby in a position which does not obstruct the view.

All of these advantages according to the invention, some of which conflict with one another, can surprisingly be achieved by means of the special kinematics according to the invention with its exact dimensions of the individual elements and their relative position with respect to one another. In this case, the start basis for the definition of the length ratios is the length of the lifting frame, the ratios being all the more favorable, the further the pivot point of the tipping lever comes to lie with respect to the front lifting-frame end, measured horizontally on the connecting line between the two bearings at the ends of said lifting frame.

Figure 2:
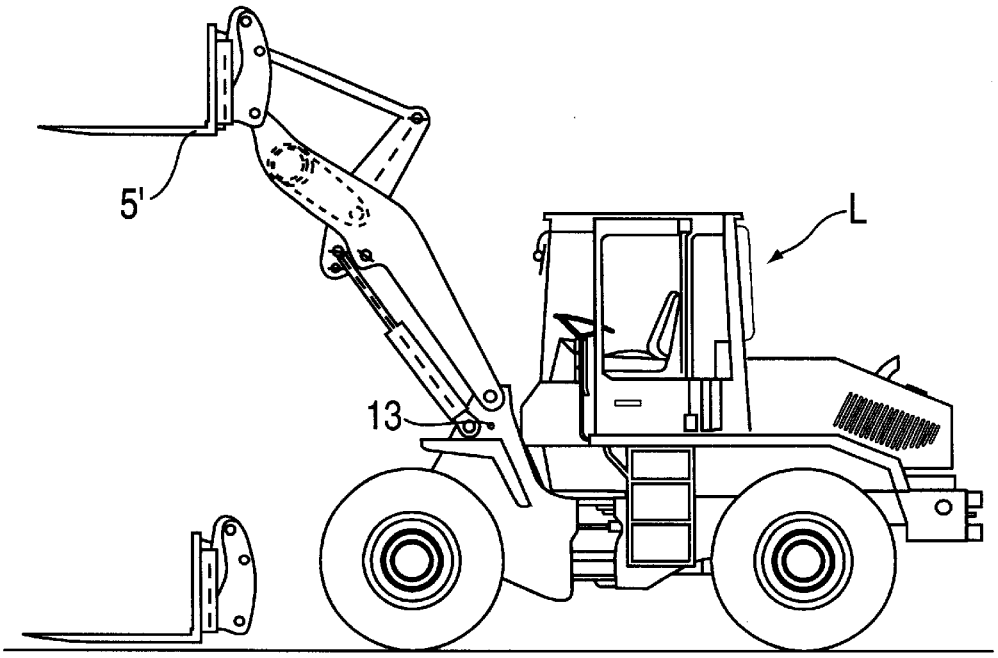
Figure 3:
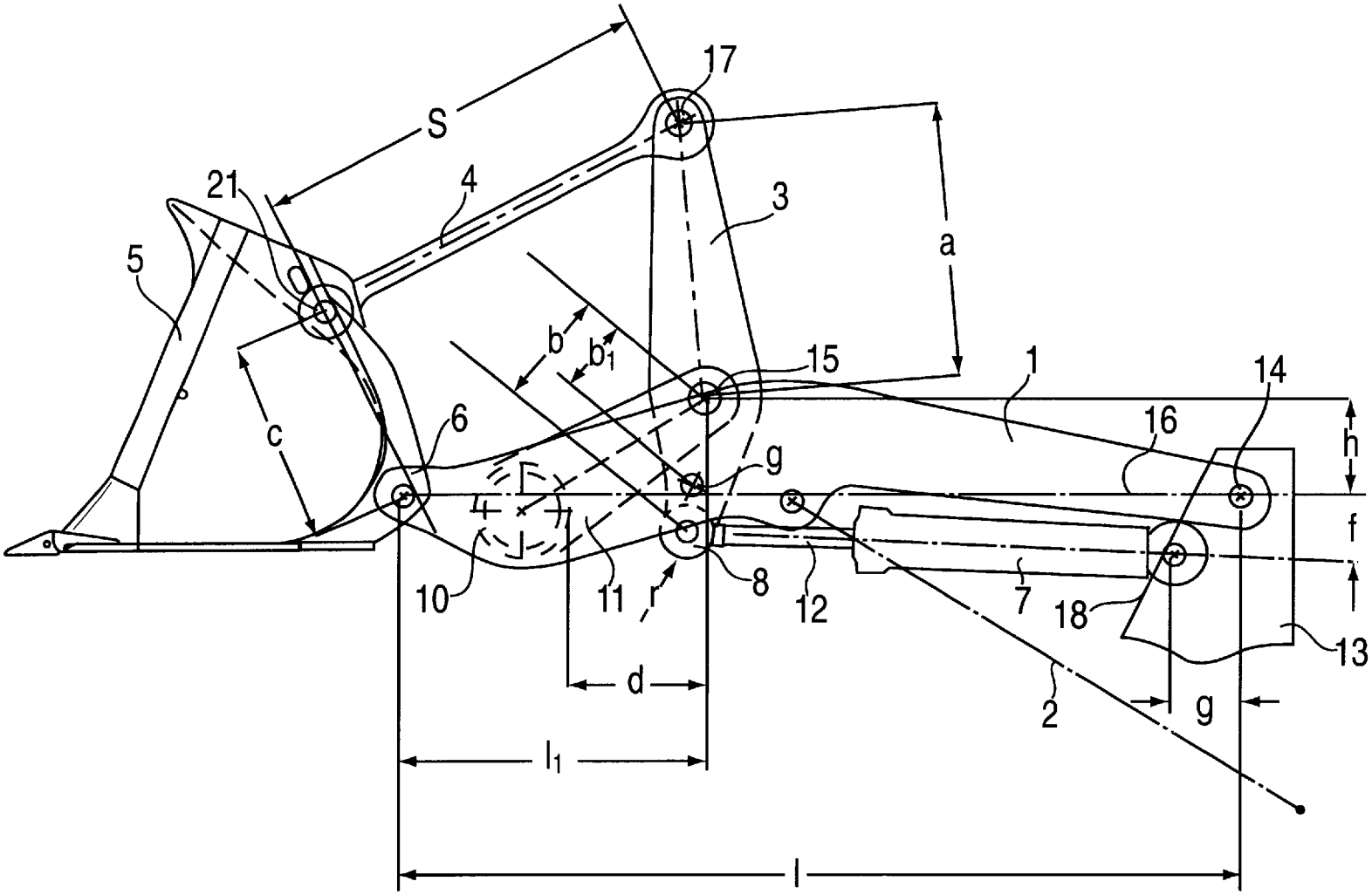
Figure 4:
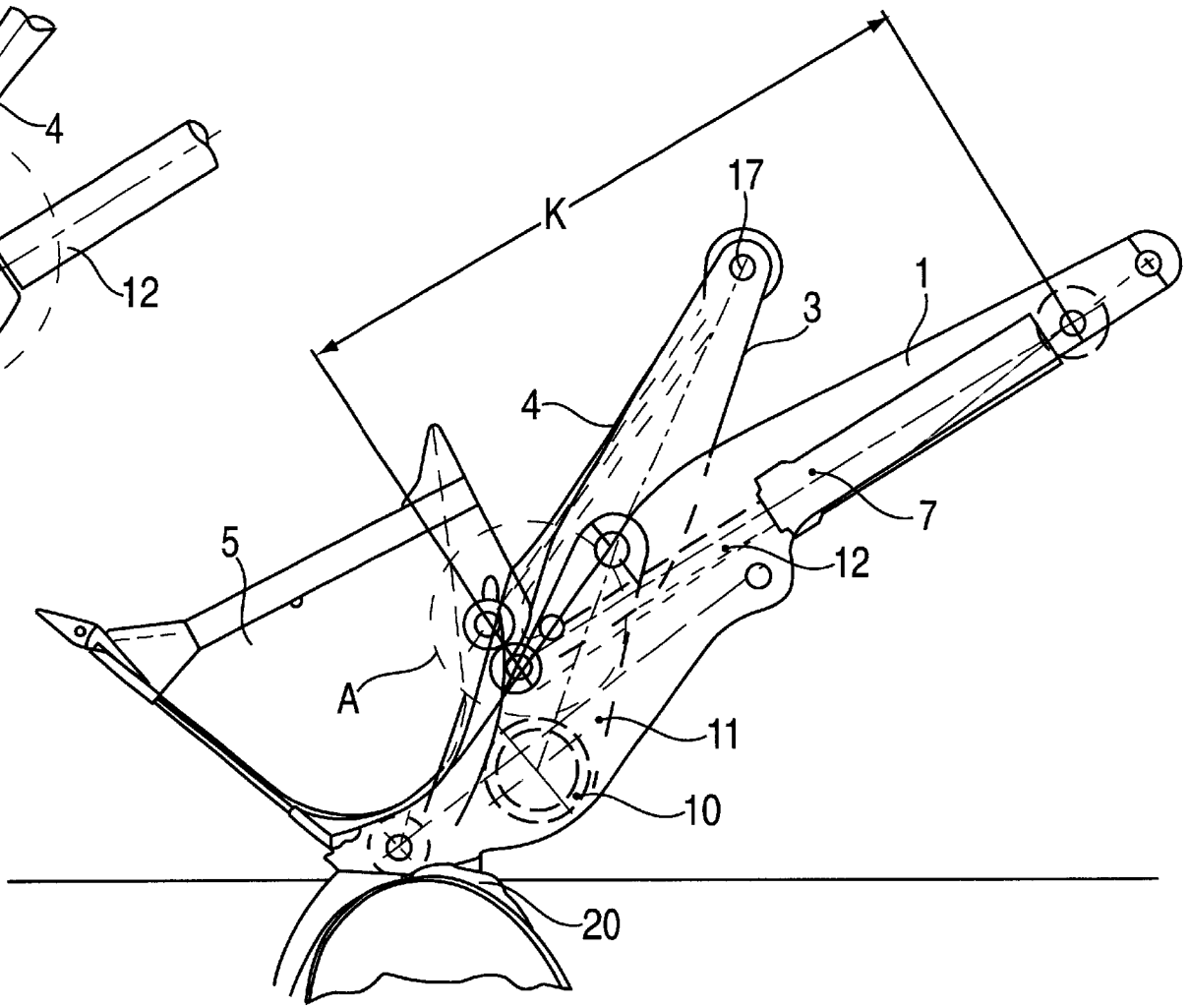
Figure 5:
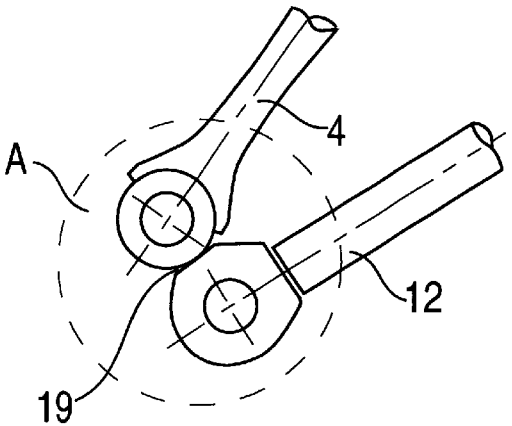
Figure 6:
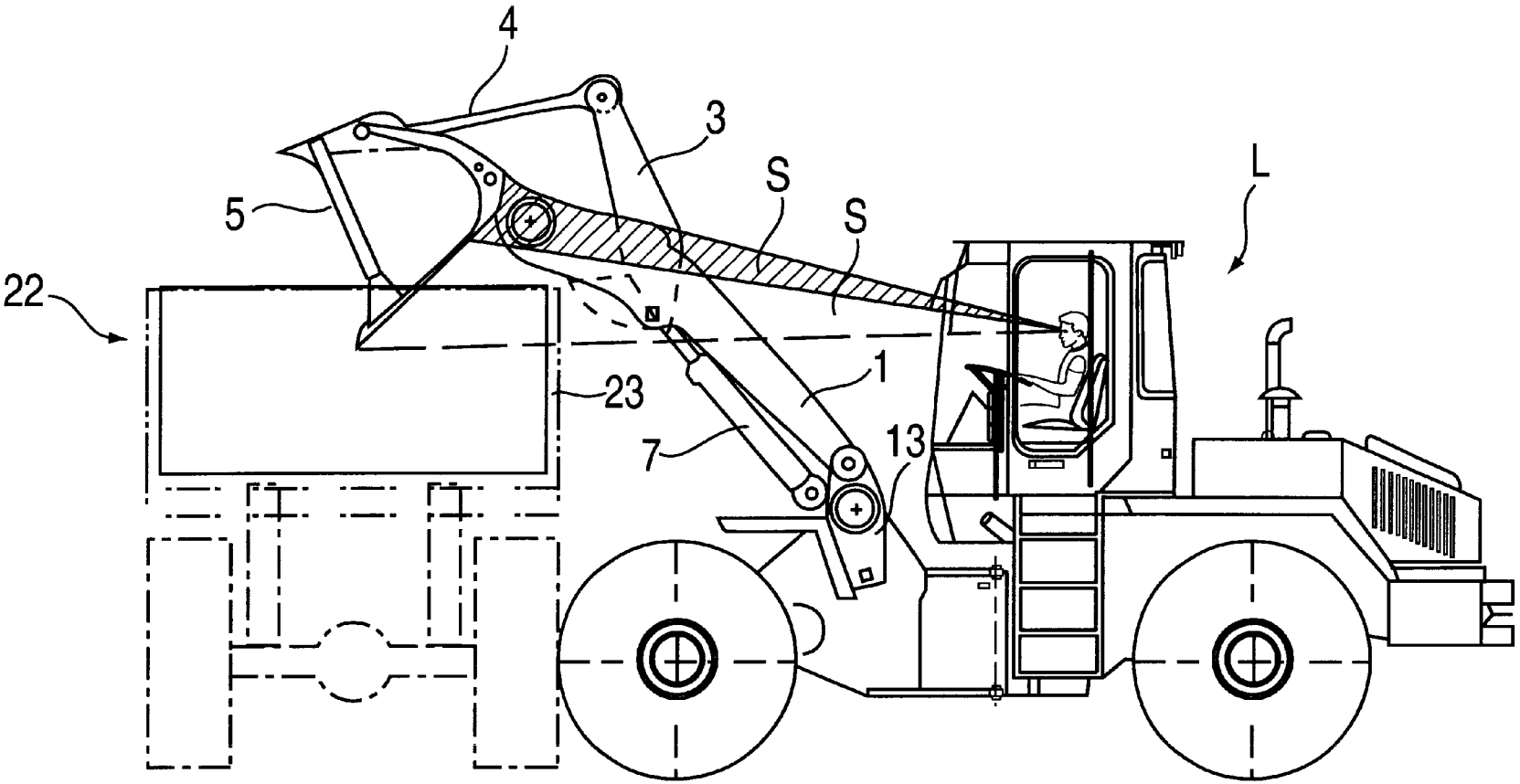
Figure 7:
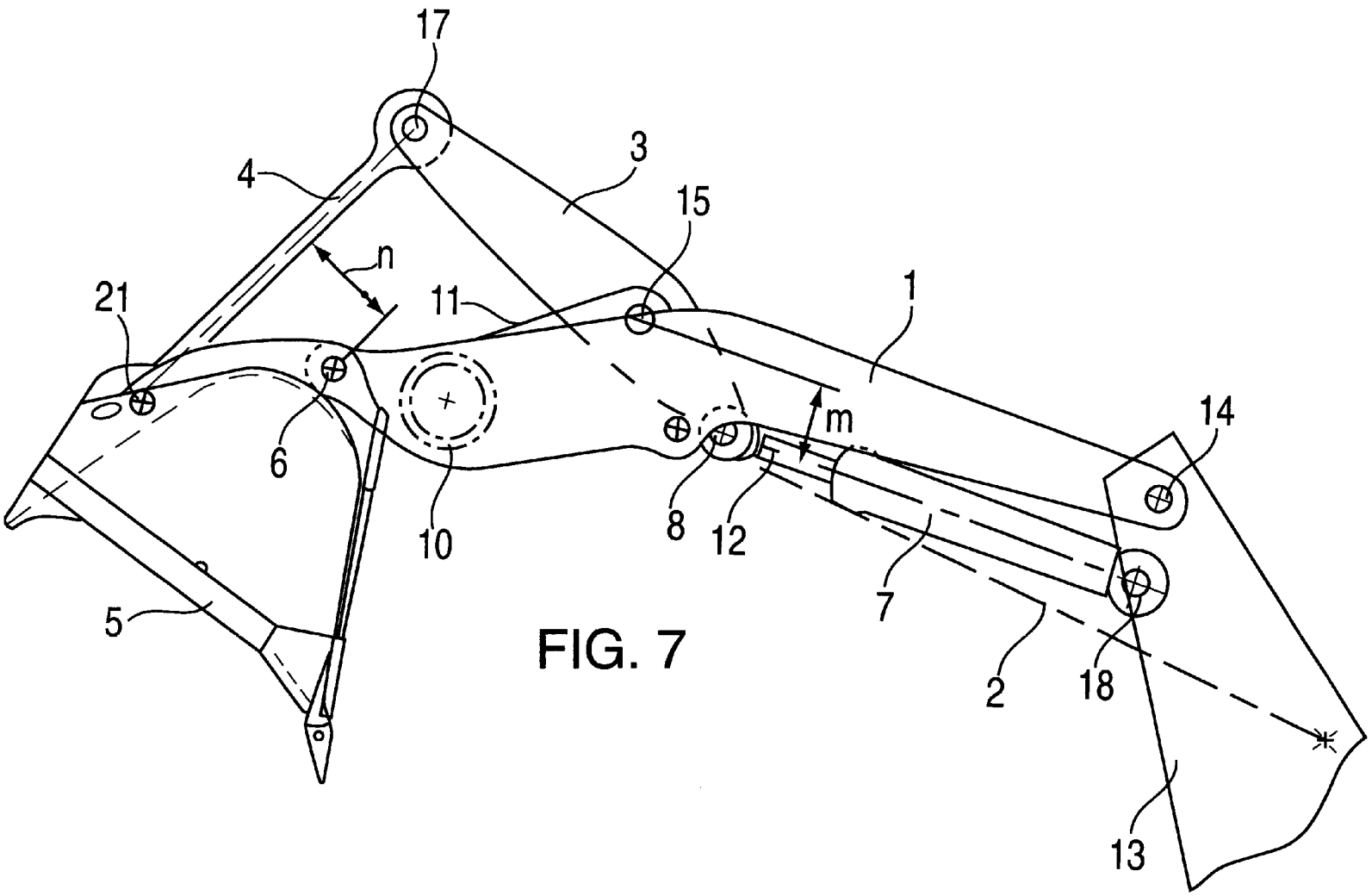

The invention is explained in more detail by way of example below with reference to the drawing, in which FIG. 1 shows, in a side view, a mobile loading machine according to the invention in shovel mode for earth moving, FIG. 2 shows the loading machine according to FIG. 1 in fork mode for industrial use, FIGS. 3 to 5 show the kinematic ratios of the loading machine according to the invention, FIG. 6 shows, in side view, a loading machine according to the invention in excavator mode when filling a transportation vehicle, and FIG. 7 shows a side view of the kinematics with the lifting frame and tipped shovel in a transportation position.

In FIGS. 1 and 2 a mobile loading machine is denoted generally by L. This loading machine L has a front frame part 13 to which is coupled the actual universal kinematics according to the invention, whose more precise construction emerges from FIGS. 3 to 6.

The kinematics first of all has a lifting frame 1 whose lifting-frame axis is denoted by 16. This lifting frame 1 is mounted rotatably at its rear end in a lifting-frame pivot point 14 on the frame part 13 of the loading machine. In this arrangement, the lifting frame 1 usually consists of two parallel frame parts. Also rotatably mounted on the frame part 13 is a lifting cylinder 2 (merely indicated) which is coupled at its other end to the lifting frame 1. By actuation of the lifting cylinder 2, the lifting frame 1 can therefore be raised and lowered, specifically about the lifting-frame pivot point 14.

At the front end of the lifting frame 1, a working shovel 5 is coupled in a shovel pivot point 6, and in the region of the front end the lifting frame 1 has, between its two lifting-frame parts, a crossbeam 10 on which two parallel tipping-lever supports 11 are arranged to whose ends a tipping lever 3 is coupled in a tipping-lever pivot point 15. The lower end of the tipping lever 3 is connected in a lower, first tipping-cylinder coupling point 8 or in an upper, second tipping-cylinder coupling point 9 situated above it, in an articulated manner to a tipping cylinder 7 which is coupled at its other end in a tipping-cylinder pivot point 18 to the frame part 13 of the loading machine. The upper end of the tipping lever 3 is coupled in a tipping-rod pivot point 17 to a tipping rod 4 which is coupled by its other end to the working shovel 5 in a tipping-rod coupling point 21 above the shovel pivot point 6.

While the lifting frame 1 can be raised and lowered by actuation of the lifting cylinder 2, the tipping lever 3 can be moved by the tipping rod 4, by extension and retraction of the piston rod 12 of the tipping cylinder 7, and the shovel 5 can therefore be pivoted.

If the piston rod 12 of the tipping cylinder 7 is coupled to the tipping lever 3 in the tipping-cylinder coupling point 8, the kinematics is suitable for a shovel action and the action as in the case of a Z-kinematics is then given (FIG. 1).

If, in contrast, the piston rod 12 of the tipping cylinder 7 is coupled in the upper, second tipping-cylinder coupling point 9, which is possible by a simple change in position, the shovel cutting edge or fork is guided upward in parallel, as illustrated in FIG. 2.

The essential advantages described above in detail of the kinematics according to the invention are achieved by special geometrical dimensions and lever ratios which are illustrated in detail in FIG. 3. In this case, the following designations are used:

l=lifting-frame length of the lifting frame 1, $l_1$=lifting-frame length between the tipping-lever pivot point 15 and shovel pivot point 6, a=distance from the tipping-lever pivot point 15 to the tipping-rod pivot point 17, b=distance from the tipping-cylinder coupling point 8 to the tipping-lever pivot point 15, c=distance from the tipping-rod coupling point 21 to the shovel pivot point 6, h=height of the tipping-lever pivot point 15 above the lifting-frame axis 16, s=length of the tipping rod 4, g=vertical distance of the tipping-cylinder pivot point 18 to the lifting-frame pivot point 14, f=horizontal distance of the tipping-cylinder pivot point 18 to the lifting-frame pivot point 14, $b_1$=distance of the tipping-cylinder coupling point 8 from the tipping-lever pivot point 15, d=clear distance of the lifting-frame crossbeam 10 to the tipping-lever pivot point 15, k=length of the extended tipping cylinder 7.

In this arrangement, the following dimensions are provided according to the invention, based on the length l of the lifting frame 1:

$l_1/l$=0.2 to 0.4, a/l=0.3 to 0.35, b/l=0.14 to 0.17, c/l=0.2 to 0.3, h/l=0.08 to 0.12, s/l=0.4 to 0.5, g/l=0.07 to 0.08, f/l=0.06 to 0.07, $b_1/l$=0.01 to 0.12, $b/l_1$=0.4 to 0.5, k/l=0.65 to 0.75.

In addition, provision is made for the distance d of the crossbeam 10 between the tipping-lever pivot point 15 and the shovel pivot point 6 to be larger than b+r.

As emerges from FIG. 5, which shows an enlarged detail A from FIG. 4, a stop 19 of the lug of the piston rod 12 of the tipping cylinder 7 is provided against the lug of the tipping rod or against the shovel 6. In addition, as emerges from FIG. 4, two shovel stops 20 are provided against the lifting frame 1 in the tipping-out position.

FIG. 6 shows a loading machine according to the invention in a shovel action when loading a transportation vehicle 22 having sideboards 23. In this arrangement, it can be seen, for one thing, that the arrangement of the tipping lever at a ratio of $c/l_1$=0.4 to 0.5 ensures that the tipping lever 3 is prevented from colliding with the sideboards. In addition, it can be seen that because of the design according to the invention, particularly good viewing conditions for the driver of the loading machine L are given. These viewing conditions are indicated by the reference symbol S; the driver is able to have a good view of the shovel 5 and also the transportation vehicle 22 and the sideboards 23.

Finally, FIG. 7 illustrates the universal kinematics according to the invention with the lifting frame 1 and tipped shovel 6 in a transportation position. In this case, in order to apply large holding forces in the tipped-out state of the shovel 6, it is provided that in the upper lifting-frame position the ratio of the distance m of the axis of the piston rod 12 of the tipping cylinder 7 from the tipping-lever pivot point 15 to the distance n of the axis of the tipping rod 4 from the shovel pivot point 6, i.e. m/n, is of an order of magnitude of 0.65 to 0.7.

What is claimed is:

1. A mobile loading machine with front-end loading equipment, said machine comprising:

a lifting frame rotatably mounted by a rear end on a front frame part (13) of the loading machine with respect to a lifting-frame pivot point and which can be raised and lowered by at least one lifting cylinder;

a working shovel, fork or the like being coupled to the front end of the lifting frame in a shovel pivot point;

a tipping lever coupled in a central region of the lifting frame in the tipping-lever pivot point, wherein a lower end of the lever is connected in a tipping-cylinder coupling point in an articulated manner to a tipping cylinder said tipping cylinder coupled at the other end in a tipping-cylinder pivot point to the frame part and whose upper end is coupled in a tipping-rod pivot point to a tipping rod which is coupled by its other end to the working shovel in a tipping-rod coupling point above the shovel pivot point, wherein the following geometrical ratios are provided, in each case based on the length l of the lifting frame:

lifting-frame length $l_1$ between the tipping-lever pivot point and shovel pivot point: $l_1/l$=0.25 to 0.4, distance a from the tipping-lever pivot point to the tipping-rod pivot point: a/l=0.3 to 0.35, distance b from the tipping-cylinder coupling point to the tipping-lever pivot point: b/I=0.14 to 0.17, distance c from the tipping-rod coupling point to the shovel pivot point: c/l=0.2 to 0.3, height h of the tipping-lever pivot point above the lifting-frame axis: h/l=0.08 to 0.12, length s of the tipping rod: s/l=0.4 to 0.5, vertical distance g of the tipping-cylinder pivot point to the lifting-frame pivot point: g/l=0.07 to 0.08, horizontal distance f of the tipping-lever pivot point to the lifting-frame pivot point: f/l=0.06 to 0.07.

2. The loading machine as claimed in claim 1 further comprising a second tipping-cylinder coupling point of the tipping cylinder on the tipping lever, wherein the distance b of the second, upper tipping-cylinder coupling point from the first, lower tipping-cylinder coupling point, based on the lifting-frame length, is $b_1/l$=0.01 to 0.12.

3. The loading machine as claimed in claim 1, wherein the lifting frame has a crossbeam arranged between the flipping-lever pivot point and the shovel pivot point and supports the tipping lever by means of a tipping-lever support.

4. The loading machine of claim 1, wherein the tipping cylinder is arranged approximately parallel to the lifting-frame longitudinal axis.

5. The loading machine as claimed in claim 1, wherein the tipping lever is arranged in such a manner that the ratio of $b/l_1$=0.4 to 0.5.

6. The loading machine as claimed in claim 1, wherein two shovel stops are provided against the lifting frame in the tipping-out position, and a stop of the lug of the piston rod of the tipping cylinder is provided against the lug of the tipping rod or against the shovel.

7. The loading machine as claimed in claim 1, wherein the maximally extended length k of the tipping cylinder, based on lifting-frame length, is k/l=0.65 to 0.75.

8. The loading machine as claimed in claim 1, wherein in the upper lifting-frame position the ratio of the distance m of the axis of the piston rod of the tipping cylinder from the tipping-lever pivot point to the distance n of the axis of the tipping rod from the shovel pivot point is m/n=0.65 to 0.7.

* * * * *